US012077904B2

(12) United States Patent
Okada et al.

(10) Patent No.: US 12,077,904 B2
(45) Date of Patent: Sep. 3, 2024

(54) TREATMENT METHOD AND TREATMENT APPARATUS

(71) Applicant: SEIKO EPSON CORPORATION, Tokyo (JP)

(72) Inventors: Hideki Okada, Shiojiri (JP); Akiko Yamada, Shiojiri (JP); Kosuke Chidate, Shiojiri (JP)

(73) Assignee: SEIKO EPSON CORPORATION (JP)

( * ) Notice: Subject to any disclaimer, the term of this patent is extended or adjusted under 35 U.S.C. 154(b) by 71 days.

(21) Appl. No.: 17/950,179

(22) Filed: Sep. 22, 2022

(65) Prior Publication Data

US 2023/0098056 A1 Mar. 30, 2023

(30) Foreign Application Priority Data

Sep. 24, 2021 (JP) ..... 2021-155724

(51) Int. Cl.
*D06M 10/00* (2006.01)
*D06P 7/00* (2006.01)

(52) U.S. Cl.
CPC ..... *D06M 10/00* (2013.01); *D06P 7/005* (2013.01)

(58) Field of Classification Search
CPC D06C 11/00; D06C 2700/15; D06C 2700/29; D06C 19/00; D06B 13/00; D06B 3/205; D06B 3/206; D06M 10/00; D06P 7/00; D06P 7/005
USPC ..... 26/25–37
See application file for complete search history.

(56) References Cited

U.S. PATENT DOCUMENTS 129,895 A * 7/1872 Ladd ..... D06C 11/00 26/37
173,398 A * 2/1876 Elwell ..... D06C 15/00 26/27
178,497 A * 6/1876 Willans ..... D06C 11/00 26/29 R
459,353 A * 9/1891 Wood ..... D06C 11/00 26/35
500,347 A * 6/1893 Ott ..... D06C 11/00 26/36
657,368 A * 9/1900 Stearns ..... D06C 29/00 26/36
1,619,814 A * 3/1927 Fisher ..... A47L 7/0047 15/311

(Continued)

FOREIGN PATENT DOCUMENTS

CN 114150463 A * 3/2022
FR 2566014 A1 * 12/1985

(Continued)

*Primary Examiner* — Amy Vanatta
(74) *Attorney, Agent, or Firm* — Harness, Dickey & Pierce, P.L.C.

(57) ABSTRACT

A treatment method includes: preparing a vibration applying section including a contact member that has a base and a plurality of protruding portions which are provided so as to protrude from the base and which come into contact with a fabric and including a vibration generation source that applies a vibration to the contact member; and a vibration applying step of, in a state in which the protruding portions are made to be in contact with the fabric, driving the vibration generation source such that the protruding portions vibrate and applying vibration to the fabric via the protruding portions.

8 Claims, 5 Drawing Sheets

(56) References Cited

U.S. PATENT DOCUMENTS

| | | | | | |
|---|---|---|---|---|---|
| 2,067,632 | A * | 1/1937 | Hadley | D06C 15/00 | 26/28 |
| 2,173,404 | A * | 9/1939 | Ubbink | A41H 41/005 | 26/27 |
| 2,305,526 | A * | 12/1942 | Hadley | D06C 11/00 | 26/28 |
| 2,566,075 | A * | 8/1951 | Taylor | D06C 15/14 | 26/26 |
| 2,629,918 | A * | 2/1953 | Swing | D06C 11/00 | 26/25 |
| 2,970,362 | A * | 2/1961 | Rankin | D06C 29/00 | 26/25 |
| 3,229,346 | A * | 1/1966 | Hadley | D06C 11/00 | 451/163 |
| 4,623,572 | A * | 11/1986 | Irrlitz | B05D 3/12 | 118/57 |
| 5,099,553 | A * | 3/1992 | Dischler | D06C 11/00 | 26/2 R |
| 2015/0375528 | A1 | 12/2015 | Kitagawa et al. | | |

FOREIGN PATENT DOCUMENTS

| | | | | | |
|---|---|---|---|---|---|
| JP | 2016-011466 | A | | 1/2016 | |
| SE | 424649 | B | * | 8/1982 | |
| WO | WO-9623924 | A1 | * | 8/1996 | D06C 11/00 |

* cited by examiner

TREATMENT METHOD AND TREATMENT APPARATUS

The present application is based on, and claims priority from JP Application Serial Number 2021-155724, filed Sep. 24, 2021, the disclosure of which is hereby incorporated by reference herein in its entirety.

BACKGROUND

1. Technical Field

The present disclosure relates to a treatment method and a treatment apparatus.

2. Related Art

For example, as described in JP-A-2016-11466, a textile printing method of performing printing by ejecting ink onto a fabric or the like has been known. The original texture and quality of a fabric are likely to deteriorate after textile printing, and improvement therefor has been demanded. Here, texture refers to the feeling of touch by hand or on the skin.

In the printing method described in JP-A-2016-11466, texture after textile printing is improved by performing heat treatment on a specific portion of a fabric before textile printing. Moreover, such heat treatment is not necessarily performed, and physical treatment entailing, for example, a method of rubbing a fabric surface by using a brush so as to roughen the surface may be adopted.

However, it is difficult to obtain excellent texture by such a method in some cases, and further improvement in fabric texture is thus demanded.

SUMMARY

A treatment method of the disclosure includes: preparing a vibration applying section including a contact member that has a base and a plurality of protruding portions which are provided so as to protrude from the base and which come into contact with a fabric and including a vibration generation source that applies a vibration to the contact member; and a vibration applying step of, in a state in which the protruding portions are made to be in contact with the fabric, driving the vibration generation source such that the protruding portions vibrate and applying vibration to the fabric via the protruding portions.

A treatment apparatus of the disclosure includes: a transport section that transports a fabric; and a vibration applying section including a contact member that has a base and a plurality of protruding portions which are provided so as to protrude from the base and which come into contact with the fabric being transported by the transport section and including a vibration generation source that applies a vibration to the contact member.

DESCRIPTION OF EXEMPLARY EMBODIMENTS

Hereinafter, a treatment method and a treatment apparatus of the disclosure will be described in detail in accordance with suitable embodiments illustrated in the accompanying drawings.

First Embodiment

Figure 1:
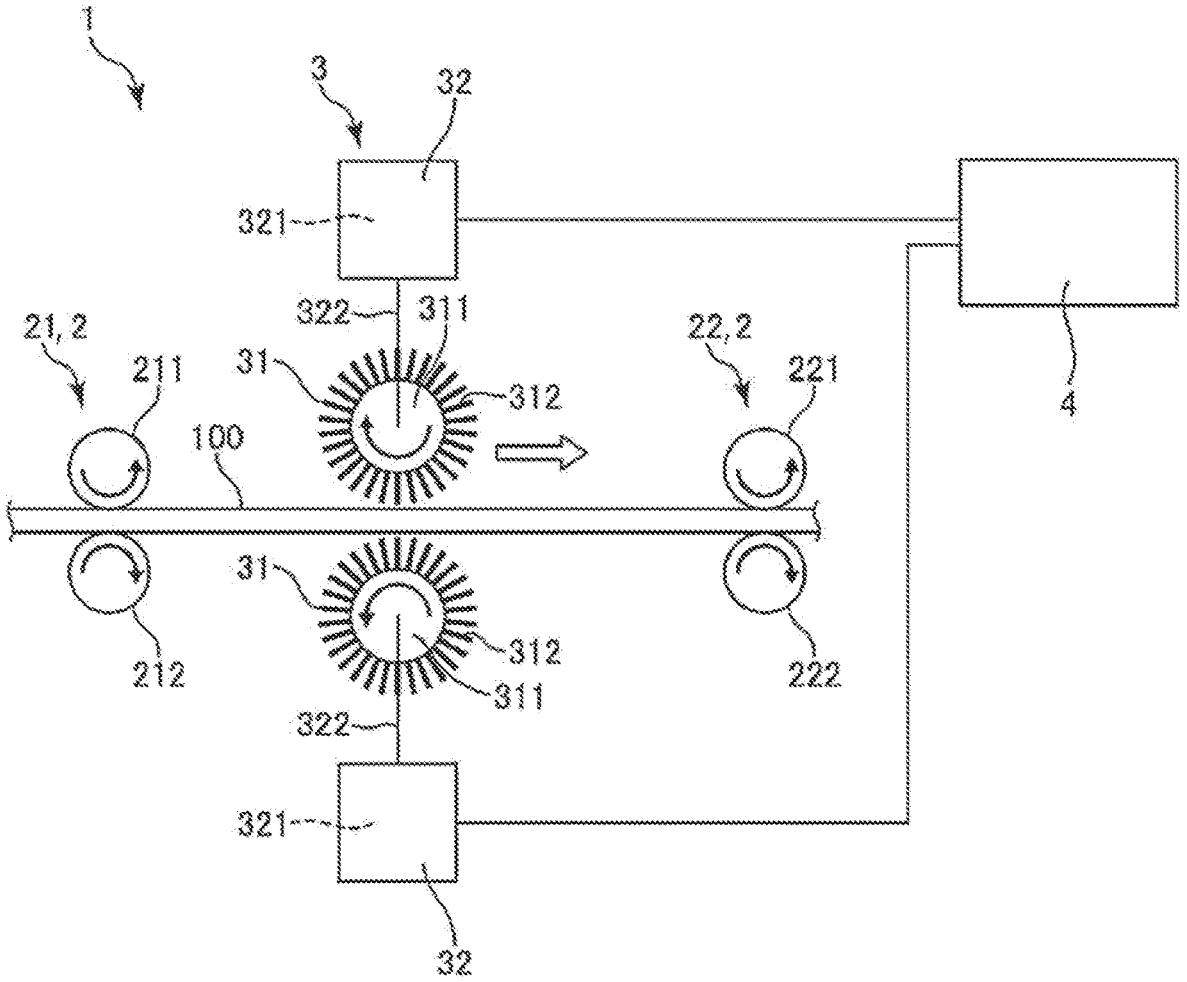
FIG. 1 is a schematic configuration view of a first embodiment of a treatment apparatus that performs a treatment method of the disclosure.

FIG. 1 is a schematic configuration view of a first embodiment of the treatment apparatus that performs the treatment method of the disclosure.

Note that, in FIG. 1 (as well as in FIGS. 2 to 7), the upper side is also referred to as "upper portion" and the lower side is also referred to as "lower portion". Moreover, in FIG. 1, the left side corresponds to an upstream portion in a transport direction of a fabric 100 and the right side corresponds to a downstream portion in the transport direction of the fabric 100.

A treatment apparatus 1 illustrated in FIG. 1 performs the treatment method of the disclosure. Note that "treatment" and "surface treatment" in the present application denote at least one type of treatment selected from bending the fabric 100, beating the fabric 100, stretching the fabric 100, and rubbing the fabric 100. The rubbing treatment is also referred to as napping treatment. By performing such treatment, it is possible to improve texture after printing. The treatment in the present embodiment corresponds mainly to stretching and rubbing. Bending and beating will be described in detail in a fifth embodiment.

A target of the treatment method of the disclosure is a fabric. Fibers constituting the fabric are not particularly limited, and examples thereof include natural fibers of cotton, hemp, wool, silk, or the like, synthetic fibers of polypropylene, polyester, acetate, triacetate, polyamide, polyurethane, or the like, biodegradable fibers of polylactic acid or the like, and mixtures of such fibers.

The fabric may be constituted by the above-described fibers in any form of a woven fabric, a knitted fabric, a nonwoven fabric, and the like. The basis weight of the fabric used in the present embodiment is not particularly limited, may be, for example, not less than 1.0 oz and not more than 10.0 oz, and is desirably not less than 2.0 oz and not more than 9.0 oz, more desirably not less than 3.0 oz and not more than 8.0 oz, and still more desirably not less than 4.0 oz and not more than 7.0 oz. When the basis weight of the fabric is within such a range, it is possible to perform excellent recording.

Examples of the form of the fabric in the present embodiment include cloth, clothing, and clothing accessories.

Examples of cloth include a woven fabric, a knitted fabric, and a nonwoven fabric. Examples of clothing and clothing accessories include sewn tee shirts, handkerchiefs, scarfs, towels, handbags, cloth bags, curtains, sheets, bedcovers, decor such as wallpaper, and cloth which has been cut or is to be cut and which is a part to be sewn. As a form of the cloth, clothing, and clothing accessories, an elongated form wound in a roll shape, a form cut to a predetermined size, a form having a product shape, and the like are adoptable. Note that the fabric to which a treatment liquid is applied in advance may be used.

A fabric which is colored in advance by using a coloring material may be used as the fabric. Examples of the coloring material for coloring the fabric in advance include a water-soluble dye, such as a pigment, an acid dye, or a basic dye, a disperse dye used with a dispersant, and a reactive dye. When a cotton fabric is used as the fabric, it is desirable that a reactive dye or a pigment suitable for dyeing cotton be used. Using a pigment is desirable from the viewpoint that a pigment is able to color relatively different types of fabric. Texture of the fabric colored by using a pigment is likely to be degraded due to a large amount of solid content existing on the surface of the fabric. However, by performing the treatment method of the disclosure, it is possible to improve the texture and cause the fabric to have the texture close to the original texture.

As illustrated in FIG. 1, the treatment apparatus 1 includes a transport section 2, a vibration applying section 3, and a control section 4 that controls operation of such sections.

The transport section 2 includes a first transport section 21 and a second transport section 22 that transport a fabric (hereinafter, referred to as "fabric 100").

The first transport section 21 is located upstream of a contact member 31 of the vibration applying section 3 in the transport direction of the fabric 100. The first transport section 21 includes a driving roller 211 and a driven roller 212 which are arranged across the fabric 100 in a thickness direction. The driving roller 211 is electrically coupled to the control section 4 via a motor (not illustrated). By controlling an energizing condition for the motor, the control section 4 is able to adjust a rotational speed of the driving roller 211, that is, a transport speed.

The driven roller 212 comes into contact with the fabric 100 transported in accordance with rotation of the driving roller 211 and rotates. The first transport section 21 described above enables the fabric 100 to be stably transported from the upstream portion toward the downstream portion.

The second transport section 22 is located downstream of the contact member 31 in the transport direction of the fabric 100. The second transport section 22 includes a driving roller 221 and a driven roller 222 which are arranged across the fabric 100 in the thickness direction. The driving roller 221 is electrically coupled to the control section 4 via a motor (not illustrated). By controlling an energizing condition for the motor, the control section 4 is able to adjust a rotational speed of the driving roller 221, that is, a transport speed.

The driven roller 222 comes into contact with the fabric 100 transported in accordance with rotation of the driving roller 221 and rotates. The second transport section 22 described above enables the fabric 100 to be stably transported from the upstream portion toward the downstream portion.

Moreover, by adjusting the rotational speeds of the driving roller 211 and the driving roller 221, it is possible to adjust tension of the fabric 100 being transported.

Note that adjustment of tension of the fabric 100 in the transport direction is able to be realized by joining rotational shafts of the driving roller 211 and the driving roller 221 via a transducer and thereby monitoring and adjusting shaft torque. When the tension of the fabric 100 in the transport direction is adjusted to a proper value, the fabric 100 to which vibration is transferred is able to resonate. It is thus possible to effectively improve texture quality of the fabric 100.

Moreover, adjustment of tension in a direction intersecting the transport direction of the fabric 100, that is, a width direction of the fabric 100, is able to be realized by using rollers having an inverted crown shape processed to be concaved, rollers arrayed so as to be symmetrically inclined from the center portion and having a helical structure, expander rollers that transport the fabric 100 by using a shape curved in an outward direction, or the like. When the tension of the fabric 100 in the width direction is adjusted to a proper value, the fabric 100 to which vibration is transferred is able to resonate. It is thus possible to effectively improve the texture quality of the fabric 100.

The vibration applying section 3 includes two contact members 31 and two vibration generation sources 32. The vibration applying section 3 has a function of applying a vibration to the fabric 100 being transported. It is thereby possible to perform treatment of the surface of the fabric 100. Treatment in the present embodiment denotes mainly treatment by which a phenomenon of stretching and rubbing occurs.

Stretching denotes the following.

Relatively high tension is applied to the fabric 100, and vibration with a short period and high amplitude is simultaneously applied to a contact member 35 in a state in which the rear surface of the fabric 100 is in contact with a protruding portion 352 of the contact member 35. At this time, due to the influence of the relatively high tension acting on the fabric 100, the fabric 100 is repeatedly stretched and relaxed in accordance with the protruding portion 352 phase. When a fiber bundle constituting the fabric 100 repeatedly expands and contracts with the protruding portion 352 as a fulcrum, it is possible to cause residual strain in a finely embossed shape in the fabric 100 which is inextensible. The residual strain in the finely embossed shape has an effect that improves the bulky feel of the inextensible fabric and is able to efficiently improve the texture of the fabric. Note that it is desirable that the protruding portion 352 have a minute area almost the same as a cycle of the weave pattern of the fibers of the fabric 100 or smaller than 10 times the cycle of the weave pattern. Furthermore, it is desirable that the protruding portion 352 have a curved shape or a planar shape which is less likely to cause stress concentration so as not to pierce or cut a fiber of the fabric 100.

Moreover, rubbing denotes the following.

Treatment of napping fibers of the fabric 100 by using the protruding portion 352 by applying predetermined tension to the fabric 100 and simultaneously applying vibration to a vibration transfer member in a state in which the surface of the fabric 100 is in contact with the protruding portion 352 of the contact member 35 is referred to as rubbing. When the fibers are napped, it is possible to obtain excellent texture.

It is desirable that protruding portions 352 have a brush-like shape and that each of the protruding portions 352 have a minute outer diameter almost the same as the cycle of the weave pattern of the fibers of the fabric 100 or smaller than the cycle of the weave pattern. Furthermore, it is desirable that each of the protruding portions 352 having the brush-like shape have appropriate Young's modulus with which the protruding portion 352 is less likely to pierce a fiber of the fabric 100. It is thus possible to retain the protruding portion 352 in a contact state with the fabric 100 without piercing the fabric, thus making it possible to effectively transfer vibration energy.

In the present embodiment, the contact members 31 are arranged across the fabric 100, which is to be transported, in the thickness direction so as to be respectively arranged on both sides. Since each of the contact members 31 has a similar configuration, except that arrangement positions are different, one of the contact members 31 will be representatively described below.

In the present embodiment, the contact member 31 is constituted by a brush and includes a base 311 and a plurality of protruding portions 312 provided so as to protrude from the base 311. The base 311 is constituted by a member having a round column shape in the present embodiment. Moreover, the base 311 is coupled to a motor (not illustrated) and rotates in a direction of an arrow in FIG. 1 when a rotational force of the motor is transferred thereto.

Moreover, the base 311 located in an upper portion relative to the fabric 100 in FIG. 1 rotates in a direction opposite to a direction in which the driving roller 211 and the driving roller 221 located in upper portions relative to the fabric 100 in FIG. 1 rotate. Further, the base 311 located in a lower portion relative to the fabric 100 in FIG. 1 rotates in a direction opposite to a direction in which the driven roller 212 and the driven roller 222 located in lower portions relative to the fabric 100 in FIG. 1 rotate. Such a configuration enables the treatment of the fabric 100 to be more effectively performed.

Each of the protruding portions 312 is elastic and has a linear shape or a rod shape. The dimensions of the respective protruding portions 312 may be the same or different. A constituent material of the protruding portions 312 is not particularly limited, and examples thereof include various resin materials and various metal materials. From the viewpoint of obtaining excellent nap, a metal material is desirably used. Although there is no particular limitation to the metal material, brass, steel, stainless steel, and the like are suitably useable. When steel is used, it is possible to more reliably nap the fabric 100. In a case in which the fabric 100 is colored by using a pigment, when brass is used, it is possible to nap the fabric 100 while suppressing a colored portion from being damaged.

Specifically, on the surface of the base 311, when an area of portions in which the protruding portions 312 are provided is S1 and when an area of a portion in which no protruding portion 312 is provided is S2, S2/S1 is desirably not less than 1 and not more than 100 and more desirably not less than 1.2 and not more than 90. This makes it possible to more effectively perform surface treatment of the fabric 100.

An average of outer diameters of the protruding portions 312 is desirably not less than 0.05 mm and not more than 5 mm, more desirably not less than 0.1 mm and not more than 4 mm, and still more desirably not less than 0.1 mm and not more than 0.4 mm. This makes it possible to sufficiently ensure a contact area of the protruding portion 312 and the fabric 100 and more effectively perform the surface treatment of the fabric 100. In particular, an effect of napping the fabric 100 is readily obtained, and the nap feels excellent in texture.

Moreover, Young's modulus of the protruding portions 312 is desirably not less than 100 E/GPa and not more than 250 E/GPa, and more desirably not less than 120 E/GPa and not more than 230 E/GPa. This makes it possible to ensure that the protruding portions 312 have sufficient Young's modulus, and it is therefore possible to more effectively perform the surface treatment of the fabric 100 with appropriate elasticity. In particular, the effect of napping the fabric 100 is readily obtained, and the nap feels excellent in texture.

Moreover, it is desirable that the protruding portion 352 be fixed with respect to the transport direction of the fabric 100 or move at a different transport speed, that is, have a speed difference with respect to the fabric 100. When a rubbing operation is repeated in a portion of the protruding portion 352 which is in contact with the fabric 100, the protruding portion 352 promotes disorder in an array of parallel fibers, deviation between intersection positions of intersecting fiber bundles, and partial breakage of fiber structures. In particular, when an average of outer diameters and Young's modulus of the protruding portions 352 are made relatively large, an effect of urging partial breakage of a fiber structure is increased. By repeating operations of partially cutting fibers and raising the cut fibers, it is possible to bring the surface of the fabric 100 into a napped state, thus making it possible to efficiently improve the texture of the fabric.

Each vibration generation source 32 includes a vibrator 321 (not illustrated) that generates a vibration. The vibrator 321 is electrically coupled to the control section 4. When the control section 4 controls an energizing condition for the vibrator 321, the vibration of the vibrator 321 is controlled.

Moreover, the vibration generation source 32 includes a vibration transfer member 322. The vibration transfer member 322 is constituted by a rigid body, couples a housing incorporating the vibrator 321 and the base 311 of the contact member 31, and transfers the vibration generated by the vibrator 321 to the contact member 31. It is thereby possible to transfer the vibration to the fabric 100 via the contact member 31.

Vibration amplitude is desirably not less than 0.1 mm and not more than 100 mm and more desirably not less than 0.2 mm and not more than 80 mm. This makes it possible to more effectively perform the surface treatment of the fabric 100.

Moreover, vibration frequency is desirably not less than 10 Hz and not more than 10000 Hz and more desirably not less than 100 Hz and not more than 2000 Hz. This makes it possible to more effectively perform the surface treatment of the fabric 100.

Further, the vibration to be transferred to the fabric 100 desirably includes a component in the thickness direction of the fabric 100 being transported. This makes it possible to more effectively perform the surface treatment.

In addition, the vibration to be transferred to the fabric 100 desirably includes a component in the transport direction of the fabric 100 being transported. This makes it possible to furthermore effectively perform the surface treatment.

Moreover, the vibration to be transferred to the fabric 100 desirably includes a component in a direction intersecting the transport direction of the fabric 100 being transported, that is, in the width direction of the fabric 100 being transported. This makes it possible to more excellently perform the surface treatment.

The control section 4 independently controls operation of each of the transport section 2 and the vibration generation sources 32. The control section 4 includes, for example, a CPU serving as a processor, RAM, and ROM in which a program is stored. Moreover, a function of the control section 4 is able to be realized when, for example, various programs are executed by the CPU.

Here, to improve the texture of the fabric 100 after textile printing, for example, treatment such as napping treatment is effective. The texture damaged by solid content adhering to the fabric due to printing is able to be restored by the treatment method of the disclosure. When such treatment is performed, heat treatment, chemical treatment, or the like has been typically performed. Moreover, treatment performed by pushing a brush or the like against the fabric or rubbing the fabric to thereby nap the fabric and improve the texture is also able to be considered. In such a method, however, there is a possibility that napping treatment is insufficient and the texture is not improved. Accordingly, the treatment apparatus 1 of the disclosure has the following configuration.

The treatment apparatus 1 includes the transport section 2 that transports the fabric 100 and the vibration applying section 3 including the contact member 31 that has the base 311 and the plurality of protruding portions 312 which are provided so as to protrude from the base 311 and which come into contact with the fabric 100 being transported by the transport section 2 and including the vibration generation source 32 that applies a vibration to the contact member 31. This makes it possible to excellently perform the surface treatment of the fabric 100. Accordingly, it is possible to improve the texture of the fabric 100. The treatment apparatus 1 is desirable particularly from the viewpoint that the texture of the fabric 100 subjected to printing is able to be improved. In particular, compared with a method of treating the fabric 100 by using only a contact member, such as a brush, it is possible to excellently nap the fabric 100 by applying vibration and improve the texture.

Moreover, the contact member 31 is desirably a brush in which the protruding portions 312 are linear. This makes it possible to more effectively perform the surface treatment of the fabric 100. Further, it is possible to obtain the contact member 31 at a lower price. Moreover, since the configuration is such that the protruding portions 312 are provided on a roller and come into contact with the fabric 100 while the roller rotates, it is possible to excellently perform napping and improve the texture.

Moreover, the treatment method of the disclosure includes a step of preparing the vibration applying section 3 described above and a vibration applying step of applying vibration to the fabric 100 by using the vibration applying section 3. That is, the treatment method of the disclosure includes the step of preparing the vibration applying section 3 including the contact member 31 that has the base 311 and the plurality of protruding portions 312 which are provided so as to protrude from the base 311 and which come into contact with the fabric 100 and including the vibration generation source 32 that applies a vibration to the contact member 31 and the vibration applying step of, in a state in which one or some of the protruding portions 312 are made to be in contact with the fabric 100, driving the vibration generation source 32 such that the protruding portions 312 vibrate and applying vibration to the fabric 100 via the protruding portions 312. This makes it possible to excellently perform treatment of the fabric 100. Accordingly, it is possible to improve the texture of the fabric 100. The treatment method of the disclosure is desirable particularly from the viewpoint that the texture of the fabric 100 subjected to printing is able to be improved. In particular, compared with a method of treating the fabric 100 by using only a contact member, such as a brush, it is possible to excellently perform napping by applying vibration and improve the texture.

Moreover, in the vibration applying step, the vibration is desirably applied to the fabric 100 while the fabric 100 is transported. This makes it possible to efficiently perform the surface treatment of the fabric.

Moreover, the transport speed is desirably not less than 1 cm/s and not more than 50 cm/s and more desirably not less than 2 cm/s and not more than 20 cm/s. This makes it possible to more reliably perform the surface treatment while efficiency in the treatment is sufficiently enhanced.

Further, a rotational speed of the contact member 31 is desirably not less than 1 rpm and not more than 100 rpm and more desirably not less than 5 rpm and not more than 50 rpm. This makes it possible to more reliably perform the treatment while efficiency in the treatment is sufficiently enhanced.

Moreover, it is desirable that the pair of contact members 31 be provided so as to be arranged across a transport path of the fabric 100 in the thickness direction of the fabric 100 and that vibration be applied from both sides in the thickness direction of the fabric 100 by using the pair of contact members 31 in the vibration applying step. This makes it possible to perform the surface treatment on both surfaces of the fabric 100.

Note that, without limitation to the above-described configuration, one of the pair of contact members 31 may be omitted. Moreover, the contact member 31 may be configured to move toward or move away from the fabric 100 being transported. In this instance, it is possible to adjust the degree of the surface treatment.

Moreover, although the contact member 31 is constituted by a brush in which the protruding portions 312 are linear in the present embodiment, the disclosure is not limited thereto, and the protruding portions 312 may have a rod shape formed of a rigid body.

Second Embodiment

Figure 2:
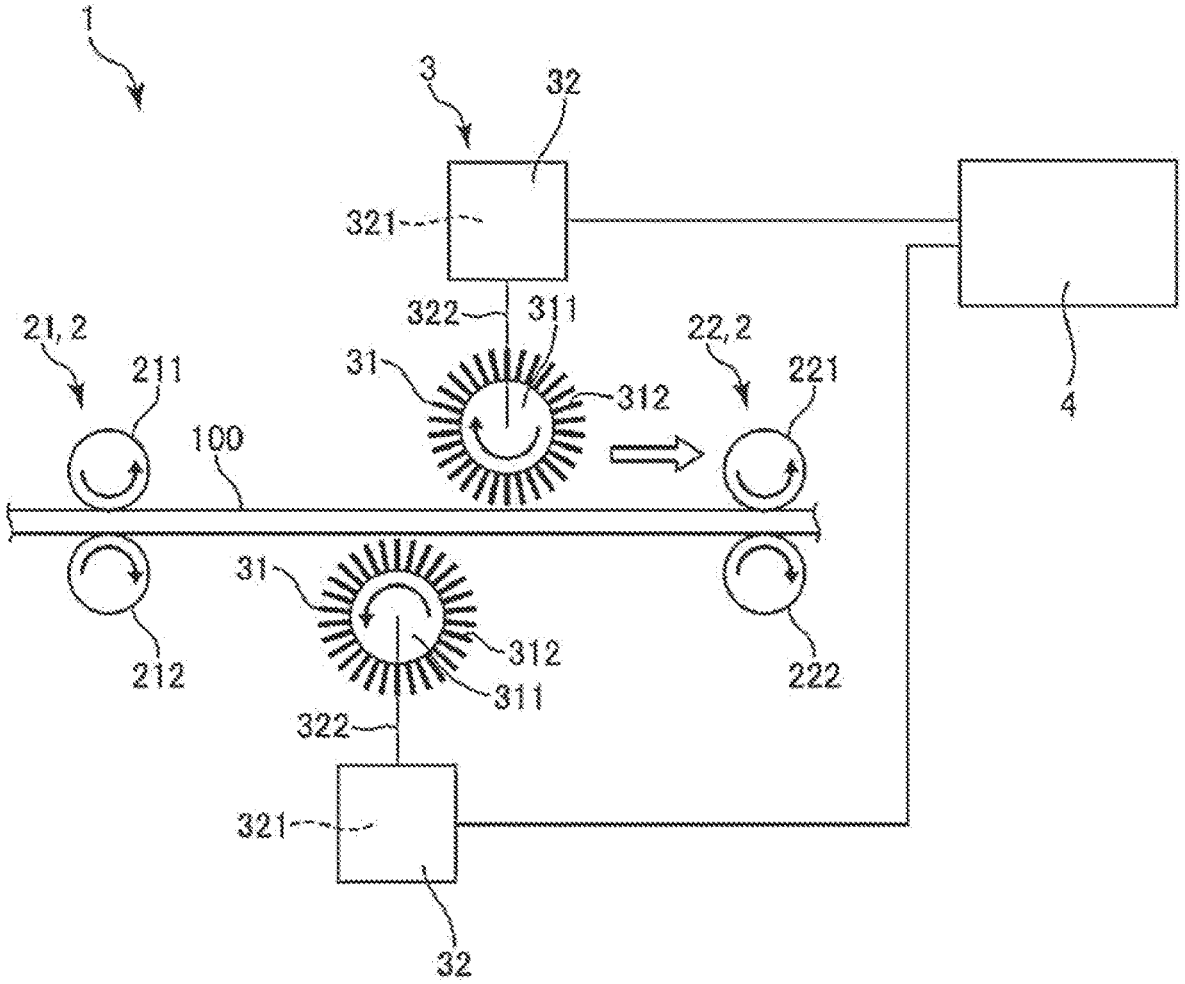
FIG. 2 is a schematic configuration view of a second embodiment of the treatment apparatus that performs the treatment method of the disclosure.

FIG. 2 is a schematic configuration view of a second embodiment of the treatment apparatus that performs the treatment method of the disclosure.

Although the second embodiment of the treatment method and the treatment apparatus of the disclosure will be described below with reference to the drawings, mainly a difference from the aforementioned embodiment will be described, and description for similar matters will be omitted.

As illustrated in FIG. 2, in the present embodiment, the pair of contact members 31 are arranged so as to be deviated from each other in the transport direction of the fabric 100. Specifically, the contact members 31 are arranged at positions at which bases 311 do not overlap each other in plan view of the fabric 100 being transported.

According to such a configuration, a position on the upper surface of the fabric 100 and a position on the lower surface thereof to each of which vibration is directly transferred from the corresponding one of the contact members 31 are able to be deviated from each other. Accordingly, even when the treatment of the fabric 100 is performed on both surfaces, it is possible to reduce damage caused by the vibration applied to the fabric 100.

Third Embodiment

Figure 3:
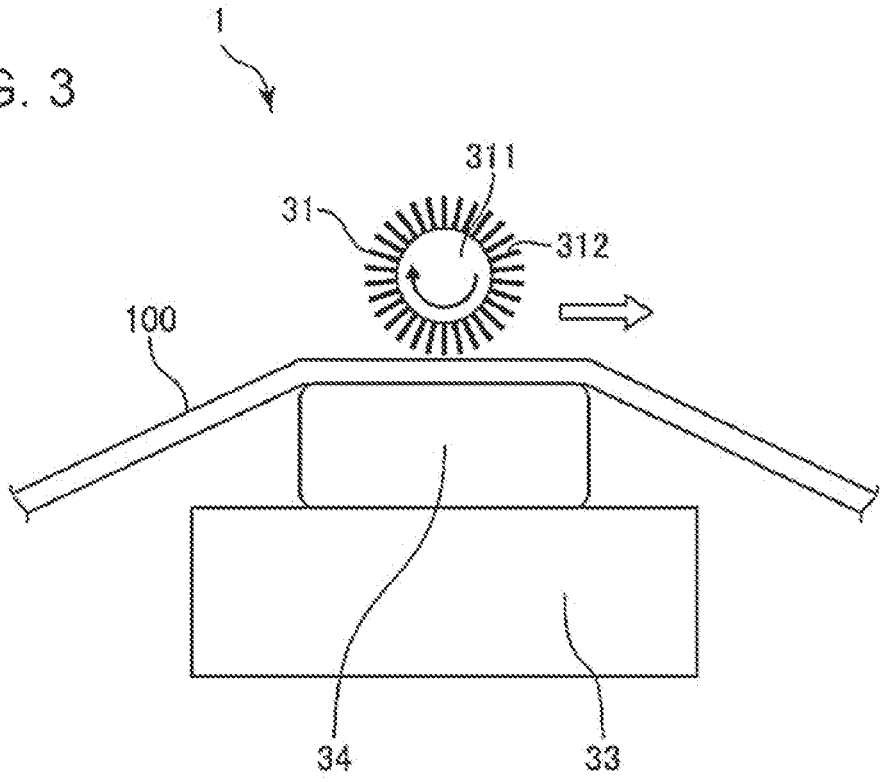
FIG. 3 is a schematic configuration view of a third embodiment of the treatment apparatus that performs the treatment method of the disclosure.

FIG. 3 is a schematic configuration view of a third embodiment of the treatment apparatus that performs the treatment method of the disclosure.

Although the third embodiment of the treatment method and the treatment apparatus of the disclosure will be described below with reference to the drawings, mainly a difference from the aforementioned embodiments will be described, and description for similar matters will be omitted.

As illustrated in FIG. 3, in the present embodiment, one contact member 31 is provided on the upper side of the fabric 100 being transported. A vibration generation source 33 in the present embodiment is arranged on the side opposite to the contact member 31 across the fabric 100 being transported.

Moreover, a vibration transfer member 34 that transfers vibration generated by the vibration generation source 33 to the fabric 100 is provided between the fabric 100 and the vibration generation source 33. The vibration transfer member 34 is constituted by an elastic body constituted by a material selected from, for example, various resin materials, various rubber materials, and the like. This makes it possible to reduce damage to the fabric 100 caused by the vibration and realize excellent surface treatment.

Fourth Embodiment

Figure 4:
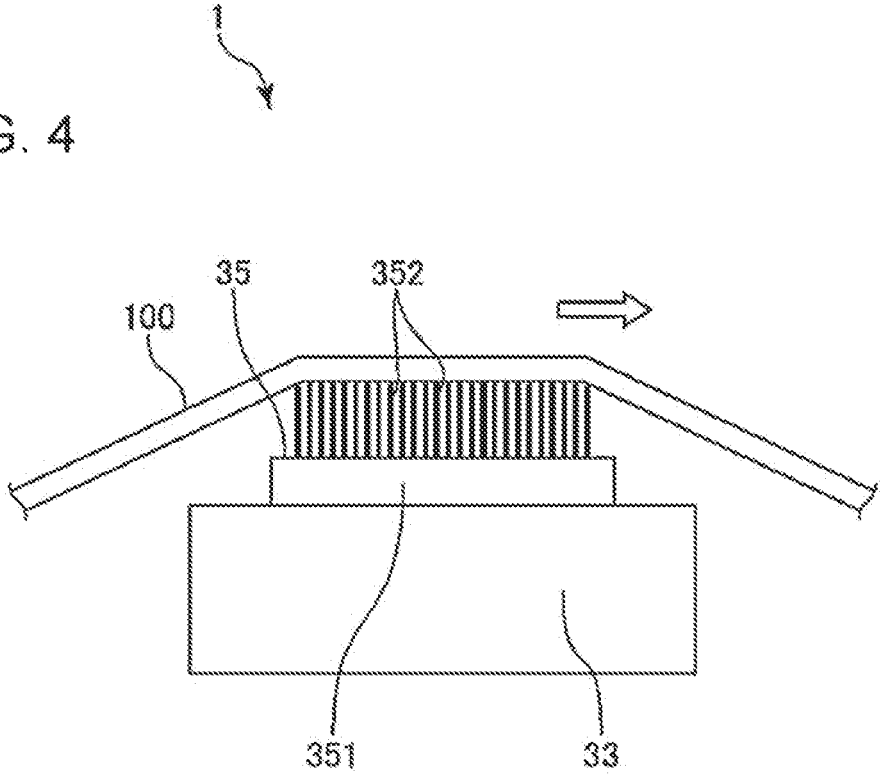
FIG. 4 is a schematic configuration view of a fourth embodiment of the treatment apparatus that performs the treatment method of the disclosure.

FIG. 4 is a schematic configuration view of a fourth embodiment of the treatment apparatus that performs the treatment method of the disclosure.

Although the fourth embodiment of the treatment method and the treatment apparatus of the disclosure will be described below with reference to the drawings, mainly a difference from the aforementioned embodiments will be described, and description for similar matters will be omitted.

As illustrated in FIG. 4, the contact member 35 in the present embodiment includes a base 351 having a planar shape and the plurality of protruding portions 352 provided so as to protrude from the base 351. The contact member 35 is arranged such that tip ends of the protruding portions 352 are in contact with the lower surface of the fabric 100. Moreover, dimensions of the respective protruding portions 352 are substantially the same.

The present embodiment described above facilitates ensuring a sufficient area and time in which and during which the protruding portions 352 and the fabric 100 are in contact with each other. Accordingly, it is possible to more reliably perform the surface treatment of the fabric 100.

Fifth Embodiment

Figure 5:
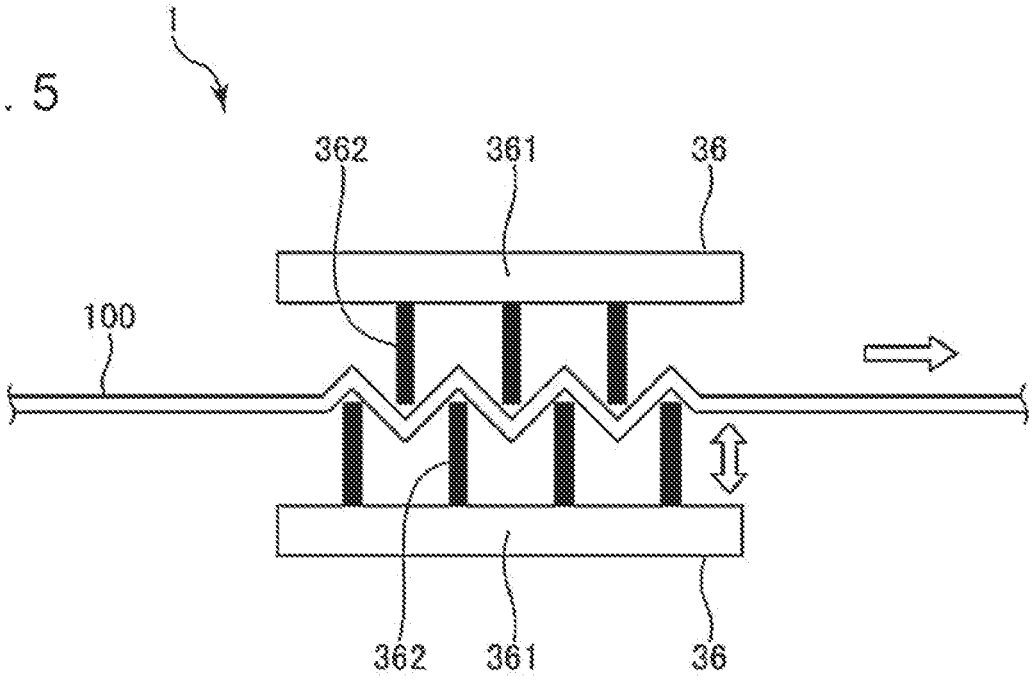
FIG. 5 is a schematic configuration view of a fifth embodiment of the treatment apparatus that performs the treatment method of the disclosure.

FIG. 5 is a schematic configuration view of the fifth embodiment of the treatment apparatus that performs the treatment method of the disclosure.

Although the fifth embodiment of the treatment method and the treatment apparatus of the disclosure will be described below with reference to the drawings, mainly a difference from the aforementioned embodiments will be described, and description for similar matters will be omitted. Note that illustration of a vibration generation source is omitted in FIG. 5.

Figure 7:
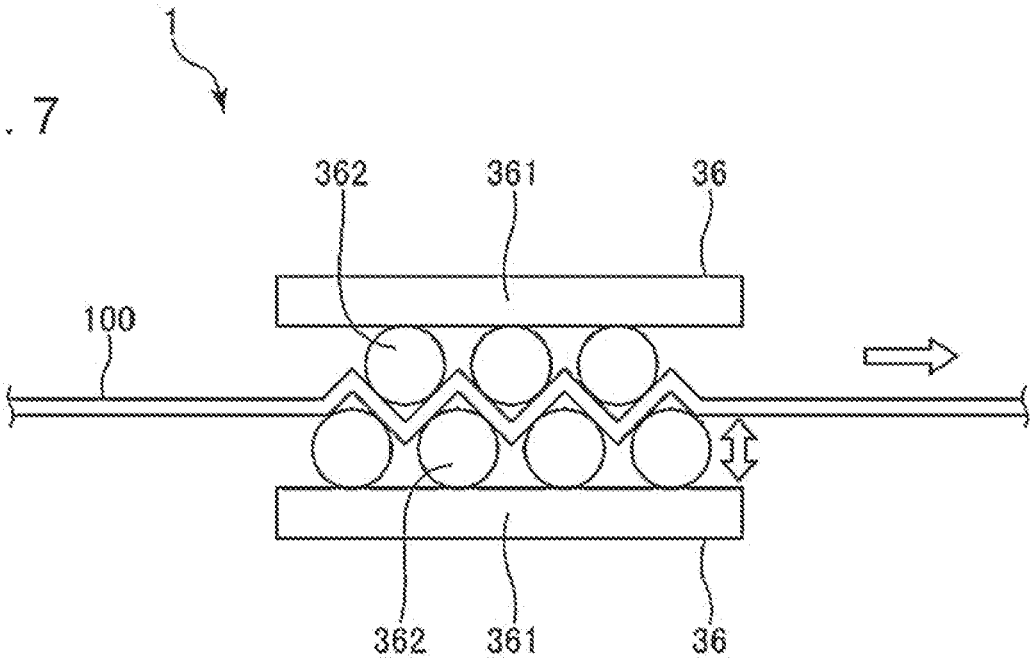
FIG. 7 is a schematic configuration view of a modified example of the treatment apparatus that performs the treatment method of the disclosure.

As illustrated in FIG. 5, a contact member 36 in the present embodiment includes a base 361 and a plurality of protruding portions 362 provided so as to protrude from the base 361. A pair of contact members 36 are provided so as to be arranged across the fabric 100 being transported. Each of the protruding portions 362 is constituted by a rigid body or a hard elastic body having a round column shape or a spherical shape as illustrated in FIG. 7.

Moreover, the protruding portions 362 may be deviated from the protruding portions 362 located on the opposite side across the fabric 100 in plan view of the fabric 100 in such a manner that the protruding portions 362 are arranged, for example, in a staggered manner. This makes it possible to prevent the protruding portions 362 from interfering with each other even when vibration amplitude is relatively high.

When the protruding portions 362 are deviated from the protruding portions 362 on the opposite side, bending is able to be highly effective.

Moreover, the protruding portions 362 are not necessarily deviated from the protruding portions 362 located on the opposite side across the fabric 100 in plan view of the fabric 100. In such an instance, beating is able to be highly effective.

According to the treatment method of the fifth embodiment described above, it is possible to perform bending and beating of the fabric 100, thus making it possible to excellently perform the treatment of the fabric 100.

Bending denotes the following.

When predetermined tension is applied to the fabric 100 and vibration is simultaneously applied to the contact member 36 in a state in which the rear surface of the fabric is in contact with a protruding portion 362 of the contact member 36, a deforming action in which a bending angle of the fiber becomes large is repeated with the protruding portion 362 as a fulcrum. As a result, assembling force between parallel fibers is relaxed, a joint point at which fiber bundles intersect is released, and partial breakage of a fiber structure progresses, thus making it possible to reduce the rigid feel of the fabric 100.

It is desirable that, when vibration is applied, an area in which the protruding portion 362 and the fabric 100 are in contact with each other be reduced to increase a curving angle with respect to the fulcrum, which is formed upon the vibration being applied. That is, it is desirable that a distance between fulcrums be increased so as to increase the amplitude caused by deformation of the fabric 100 upon the vibration being applied to the fabric 100. The amplitude of the fabric caused by transferred vibration energy is thereby increased, and the bending angle of the fiber therefore becomes large, thus making it possible to reduce the rigid feel of the fabric 100 and make the texture more excellent.

When vibration is applied, it is desirable that the vibration according to a vibration period/vibration amplitude of a natural frequency of the fabric 100 and tension of the fabric 100 be applied. This brings the fabric 100 into a resonance state. Accordingly, a more effective bending operation is able to be repeated with low vibration energy, and it is possible to efficiently improve the texture of the fabric.

Moreover, beating denotes the following.

Relatively low tension is applied to the fabric 100, and vibration is simultaneously applied from both surfaces of the fabric 100 to the contact members 36 in a state in which the contact members 36 fit each other. When vibration is applied in a state in which the protruding portions 362 fit each other from both surfaces of the fabric 100 as if the protruding portions 362 intersect or come into contact with each other in a direction perpendicular to the front surface of the fabric 100 and a direction perpendicular to the rear surface thereof, and a portion of the fabric 100 repeatedly comes into contact with the protruding portions 362 or the base 361 of the contact member 36, an effect of beating is able to be obtained. Compression and restoration of the fiber bundles are thereby repeated. At this time, disorder in an array of parallel fibers, deviation between intersection positions of intersecting fiber bundles, and partial breakage of a fiber structure progress, a space between fibers is expanded, a distance between fiber bundles is extended, napping caused when a portion of a fiber is cut progresses, and the bulky feel of the fabric is improved, making it possible to efficiently improve the texture of the fabric.

Moreover, when the protruding portions 362 are arranged, for example, in a staggered manner so as not to come into contact with each other, a relatively weak beating operation performed upon contact with the base 361 of the contact member 36 and a relatively weak bending operation performed with the protruding portions 362 as the fulcrums are able to be simultaneously repeated on the fabric 100, thus making it possible to efficiently improve the texture of the fabric.

Note that, when the protruding portions 362 are arranged such that the fabric 100 repeats free fall, which is caused due to the gravity, and rebound, a high concentrated stress is applied from both surfaces of the fabric 100 in a very short time due to contact between the protruding portions 362, and compression and restoration of the fiber bundles are thus repeated in the fabric 100. At this time, disorder in an array of parallel fibers, deviation between intersection positions of intersecting fiber bundles, and partial breakage of a fiber structure progress, a space between fibers is expanded, a distance between fiber bundles is extended, napping caused when a portion of a fiber is cut progresses, and the bulky feel of the fabric is improved, making it possible to efficiently improve the texture of the fabric.

Figure 6:
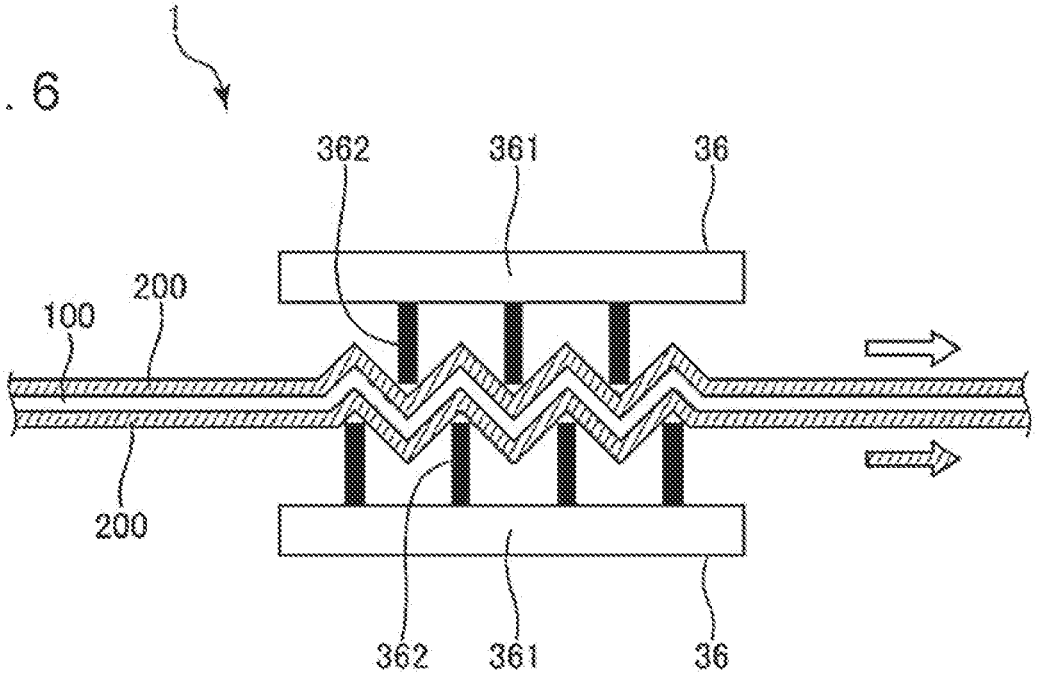
FIG. 6 is a schematic configuration view of a modified example of the treatment apparatus that performs the treatment method of the disclosure.

Moreover, as illustrated in FIG. 6, the fabric 100 may be transported or treated in a state of being held by sheet-like intermediate members 200 from both surface sides. This makes it possible to prevent or suppress a contact mark from being generated in the fabric 100 by the protruding portion 362. As the sheet-like intermediate members 200, ones similar to the fabric 100 may be used, and releasable sheets having flexibility are desirably used.

Moreover, the tip ends of the protruding portions 362 are desirably round. This makes it possible to more effectively prevent the protruding portions 362 from damaging the fabric 100. Note that the tip ends of the protruding portions 362 may be sharp. Note that a curvature of the tip end of the protruding portion 362 is, for example, desirably such that a curvature radius is not less than 1 mm and not more than 100 mm and more desirably such that the curvature radius is not less than 3 mm and not more than 80 mm. This makes it possible to suppress a treatment mark generated by contact of the protruding portion 362 from being generated even when printing is performed on the surface of the fabric.

The dimension of the protruding portion 362 (dimension from the base 361 to the tip end of the protruding portion 362) is desirably not less than 1 mm and not more than 100 mm and more desirably not less than 10 mm and not more than 50 mm. This makes it possible to make a beating effect obtained by the protruding portions in an upper portion and a lower portion more excellent when vibration is applied in a state in which the protruding portions 362 intersect each other in the direction perpendicular to the front surface of the fabric 100 and the direction perpendicular to the rear surface thereof.

Although the embodiments of the treatment method and the treatment apparatus of the disclosure, which are illustrated in the drawings, have been described above, the disclosure is not limited thereto. Moreover, each step or each section of the treatment method and the treatment apparatus is able to be replaced with any step or any structure capable of exerting a similar function. Further, any step or any structure may be added.

What is claimed is:

1. A treatment method comprising:

preparing a vibration applying section including a contact member that has a base and a plurality of protruding portions which are provided so as to protrude from the base and which come into contact with a fabric and including a vibration generation source that applies a vibration to the contact member; and a vibration applying step of, in a state in which the plurality of protruding portions are made to be in contact with the fabric, driving the vibration generation source such that the plurality of protruding portions vibrate and applying the vibration to the fabric via the plurality of protruding portions, wherein the fabric is colored by using a pigment before the plurality of protruding portions rotationally come into contact with the fabric, the contact member rotates to make the plurality of protruding portions rotationally come into contact with the fabric, and a rotational speed of the contact member is in a range of 1 rpm to 100 rpm, and the vibration generation source generates the vibration having a vibration frequency being in a range of 10 Hz to 10000 Hz.

2. The treatment method according to claim 1, wherein in the vibration applying step, the vibration is applied to the fabric while the fabric is transported.

3. The treatment method according to claim 1, wherein a pair of the contact members is provided so as to be arranged across a transport path of the fabric in a thickness direction of the fabric, and in the vibration applying step, the vibration is applied from both sides of the fabric in the thickness direction by using the pair of the contact members.

4. The treatment method according to claim 1, wherein tip ends of the plurality of protruding portions are rounded.

5. The treatment method according to claim 1, wherein the contact member is a brush in which the plurality of protruding portions are linear.

6. The treatment method according to claim 1, wherein an average of outer diameters of the plurality of protruding portions is not less than 0.05 mm and not more than 5 mm.

7. The treatment method according to claim 1, wherein

Young's modulus of the plurality of protruding portions is not less than 100 E/GPa and not more than 250 E/GPa.

8. A treatment apparatus comprising:

a transport section that transports a fabric; and a vibration applying section including a contact member that has a base and a plurality of protruding portions which are provided so as to protrude from the base and which come into contact with the fabric being transported by the transport section and including a vibration generation source that applies a vibration to the contact member, wherein the fabric is colored by using a pigment before the plurality of protruding portions rotationally come into contact with the fabric, the contact member rotates to make the plurality of protruding portions rotationally come into contact with the fabric, and a rotational speed of the contact member is in a range of 1 rpm to 100 rpm, and the vibration generation source generates the vibration having a vibration frequency being in a range of 10 Hz to 10000 Hz.

* * * * *